US008529745B2

(12) United States Patent
Hasan et al.

(10) Patent No.: US 8,529,745 B2
(45) Date of Patent: Sep. 10, 2013

(54) ELECTROPHORETIC FABRICATED FREESTANDING ALL-NANOPARTICLE THIN FILM MATERIALS

(75) Inventors: Saad Hasan, Nashville, TN (US); James Dickerson, Nashville, TN (US)

(73) Assignee: Vanderbilt University, Nashville, TN (US)

( * ) Notice: Subject to any disclaimer, the term of this patent is extended or adjusted under 35 U.S.C. 154(b) by 902 days.

(21) Appl. No.: 12/587,401

(22) Filed: Oct. 5, 2009

(65) Prior Publication Data

US 2011/0079514 A1 Apr. 7, 2011

(51) Int. Cl.
*C25D 1/14* (2006.01)

(52) U.S. Cl.
USPC ..... 204/483

(58) Field of Classification Search
USPC ..... 204/483
See application file for complete search history.

(56) References Cited

U.S. PATENT DOCUMENTS 6,919,009 B2 * 7/2005 Stonas et al. ..... 205/74

OTHER PUBLICATIONS

Tang ("Utilizing Electrochemical Deposition for Micro Manufacturing", Multi-Material Micro Manufacture, published by Whittles Publishing Ltd., http://www.4m-net.org/KnowledgeBase/papers/2008/01-04, Jul. 2008).*

Achermann, M., et al., *Nanocrystal-based light emitting diodes utilizing high efficiency nanradiative energy transfer for color conversion*. Nano Letters, 2006, 6(7): pp. 1396-1400.

Coe, S., et al., *Electroluminescence from single monolayer of nanocrystals in molecular organic devices*. Nature, 2002, 420(6917): pp. 800-803.

Sun, S.H., et al., *Monodisperse FePt nanoparticles and ferro magnetic FePt nanocrystal superlattices*. Science, 2000, 287(5460): pp. 1989-1992.

Kong, J., et al., *Synthesis of individual single-walled carbon nanotubes on patterned silicon waters*. Nature, 1998, 395(6705): pp. 878-881.

Morral, A.F.I., et al., *Synthesis of silicon nanowires with wurtzite crystalline structure by using standard chemical vapour deposition*. Advanced Materials, 2007, 19(10): pp. 1347-.

Mamedov, A.A., and N.A. Kotov, *Free-standing layer-by-layer assembled films of magnetite nanoparticles*. Langmuir, 2000, 16(13): pp. 5530-5533.

Ariga, K., J.P. Hill, and Q.M. Ji, *Layer-by-layer assembly as a versatile bottom-up nanofabrication technique for exploratory research and realistic application*. Physical Chemistry Chemical Physics, 2007, 9(19): pp. 2319-2340.

Kuipers. E.W., C. Laszlo, and W. Wiedldraaijer, *Deposition of Nanocrystals on Flat Supports by Spin-Coating*. Catalysis Letters, 1993, 17(1-2): pp. 71-79.

Islam, M.A. and I.P. Herman, *Electrodeposition of patterned CdSe nanocrystal films using thermally charged nanocrystals*. Applied Physics Letters, 2002, 80(20): pp. 3823-3825.

Tian, Y.C. and J.H. Fendler, *Langmuir-Blodgett film formation from fluorescence-activated, surfactant-capped, size-elected CdSe nanoparticles spread on water surfaces*. Chemistry of Materials, 1996, 8(4): pp. 969-974.

(Continued)

*Primary Examiner* — Kishor Mayekar
(74) *Attorney, Agent, or Firm* — John Bruckner PC

(57) ABSTRACT

Methods and apparatus for electrophoretic fabricating free-standing all nanoparticle thin films, and the resulting compositions of matter, are described. A method includes electrophoretically depositing a thin film of nanoparticles on a sacrificial layer; and freeing the thin film from the sacrificial layer. A composition of matter includes a free standing thin film of nanoparticles with no functionalized nanoparticles or chemical cross linkers.

2 Claims, 11 Drawing Sheets

(56) References Cited

OTHER PUBLICATIONS

Islam, M.A., et al., *Controlled electrophoretic deposition of smooth and robust films of CdSe nanocrystals*. Chemistry of Materials, 2004, 16(1): pp. 49-54.

Podgrabinski, T., et al., *Characterization of polystyrene and doped polymethylmethactylate thin layers*. Journal of Materials Science-Materials in Electronics, 2005, 16(11-12): pp. 761-765.

Park, J., et al., *Ultra-large-scale syntheses of monodisperse nanocrystals*. Nature Materials, 2004, 3(12): pp. 891-895.

Kitchell, J.P., and D.L. Wise., *Poly(Lactic Glycolic Acid) Biodegradable Drug Polymer Matrix Systems*. Methods in Enzymology, 1985, 112: pp. 436-448.

Lin, Y., et al., Ultra thin *cross-linked nanoparticle membranes*. Journal of the American Chemical Society, 2003, 125(42): pp. 12690-12691.

Kendall, K., *Adhesion-Molecules and Mechanics*. Science, 1994, 263(5154): pp. 1720-1725.

Lalatonne, Y., J., Richardi, and M.P. Pileni, *Van der Waals versus dipolar forces controlling mesoscopic organizations of magnetic nanocrystals*. Nature Materials, 2004, 3(2): pp. 121-125.

Lee. D., et al., *Viscoplastic and granular behavior in films of colloidal nanocrystals*. Physical Review Letters, 2007, 98(2).

Islam, M.A., et al., *Addition, suppression, and inhibition in the electrophoretic deposition of nanocrystal mixture films for CdSe nanocrystals with gamma-$Fe_2O_3$ and Au nanocrystals*. Nano Letters, 2003, 3(11): pp. 1603-1606.

Mahajan, S.V., et al., *Structural properties of electrophoretically deposited europium oxide nanocrystalline thin films*. J. Master. Sci., 2006, 41(24): pp. 8160-8165.

Collier, C.P., et al., J.R. Annu. Rev. Phys. Chem., 1998, 49: pp. 371-404.

Mahajan, S.V., et al., Nanotechnology, 2008, 19, 195301.

Somarajan, S., et al., J. Phys. Chem. B, 2008, 112, pp. 23-28.

* cited by examiner

- Novel macromolecules featuring compact, three-dimensional body with several polymer chains as arms linked to a core.
- *To facilitate the use of star polymers in device applications, more must be learned about their behavior in deposition schemes such as EPD.*
- We study polystyrene/divinylbenzene (PS/DVB) system: PS arms linked at the core by DVB molecules.

Repeat unit of PS shown with nitroxide-catalyzed terminus.

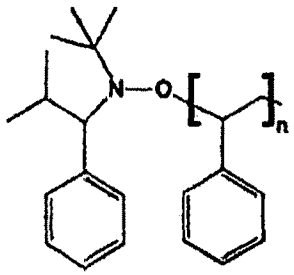

FIG. 6B

DVB molecule.

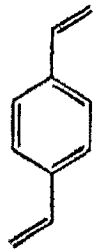

FIG. 6C

DLS measurement in DCM solvent shows the SP diameter is ~20 nm.

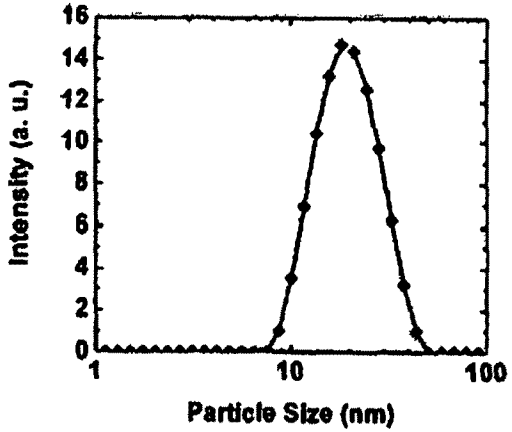

FIG. 6D

ELECTROPHORETIC FABRICATED FREESTANDING ALL-NANOPARTICLE THIN FILM MATERIALS

BACKGROUND INFORMATION

Semiconducting, insulating, and metallic nanoparticles have attracted considerable interest recently due to their size-dependent, quantum confinement characteristics, which make them attractive for a broad platform of optical, magnetic, and electronic devices. Proposed commercial applications include solid state lighting devices, magnetic recording media, ultra-light video displays, and bio-imaging reagents.

Colloidal nanoparticles (NPs) have diverse, attractive size-dependent electronic, optical and magnetic properties. These colloidal nanoparticles include an inorganic core material surrounded by organic ligand molecules.

Wet processing techniques, for example spin casting, are relatively cheap and easy methods to form dry casts of NPs for device applications. However, these wet methods have serious shortcomings, such as imposing requirements on the deposition surface or limited lateral patterning capacity. The most widely used methods for casting nanoparticle (NP) constituents into densely packed, thermally stable films, such as evaporation-driven self assembly and Langmuir-Blodgett casting, also have recognized serious limitations, including the inability to achieve both large-scale ordering of the nanoparticles as well as robust chemical and structural properties.

Meanwhile, thin films of nanocrystals have been proposed for applications as diverse as solid-state lighting,[1,2] magnetic storage,[3] and catalysis.[4,5] Typically, these thin films of nanocrystals remain permanently attached to the bulk substrates upon which they were initially assembled.

There do exist techniques to construct freestanding nanostructured films, for which the film is assembled over a temporary substrate and the substrate then dissolved.[6] A wide assortment of NP-only assemblies have been reported, but all are either attached to the original substrate or limited to microscopic dimensions.[22] Several groups have produced macroscopic structures of NPs, but only with the aid of chemical crosslinkers or by forming polymer composites.[23, 24]

For instance, a composite film of oppositely charged nanoparticles and polyelectrolyte was produced by an electrostatically driven layer-by-layer (LbL) assembly process. However, this LbL method is severely limited because it cannot be used for uncharged nanoparticles. This severely limits the selection of functional materials that may be assembled in this fashion. The production of films comprising one type of nanoparticle via LbL processing requires particles with complementary binding interactions, e.g. electrostatic or covalently coordinated.[7]

What is needed is an approach to fabricating macroscopic structures of nanoparticle-only thin films that achieve both large-scale ordering of the nanoparticles as well as robust chemical and structural properties, but without 1) the aid of chemical crosslinkers or the formation of polymer composites; and preferably simultaneously without 2) imposing requirements on the deposition surface or limited lateral patterning capacity.

SUMMARY OF INVENTION

The invention can include the production of a thin film and removal of the thin film using a polymer interface. The thin film can be (and/or include) a nanocrystalline film. The invention can include the use of a polymer sacrificial layer to facilitate the lift-off (removal) of the nanocrystalline film. The invention can include a procedure employing commercially available polymer materials such as, for example, polystyrene and PLGA [poly(lactic-co-glycolic acid)].

The invention can be embodied so that it assembles nanometer-sized crystalline particles (nanocrystals) with useful functionalities into a self-sustained freestanding solid material from a liquid solution phase. This procedure is an improvement over existing techniques because it does not require an external matrix material, such as polymer matrix, or chemical cross-linker molecules to form or to sustain the freestanding nanocrystalline material.

BRIEF DESCRIPTION OF DRAWINGS

FIGS. 6B-6D depict b) a repeat unit of polystyrene, c) a divinylbenzene molecule and d) DLS intensity as a function of particle size of a polystyrene/divinylbenzene system in a DCM solvent.

DESCRIPTION OF PREFERRED EMBODIMENTS

Figures 1A, 1B, 1C:
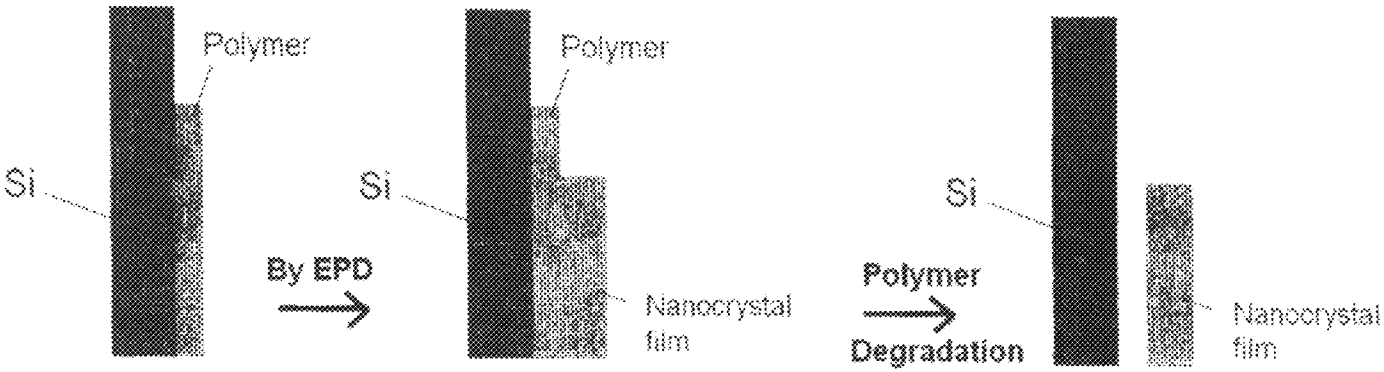
FIG. 1A-1C are schematics of a procedure to produce a freestanding nanocrystalline thin film: a) a polymer layer is first spin-coated onto the substrate, b) a nanocrystal film is deposited onto the substrate via electrophoretic deposition and c) the polymer layer is dissolved, leaving the nanocrystal film free from the substrate.

Nanoparticle deposition schemes require an understanding of both the nanoparticle dynamics in solution and the interactions that govern nanoparticle-substrate and nanoparticle-nanoparticle binding. Further, these procedures require knowledge of the intrinsic and collective properties of nanoparticles that arise from of electrostatic, magnetic, and fluctuating electric dipole effects. The organization and stability of colloidal nanoparticle assemblies are markedly affected by the surface charge state of the constituents. For nanoparticles to be employed in an array of commercial and industrial applications, a technique for the facile, rapid, and site-selective assembly of homogeneous, densely packed, defect-free thin films must be realized. The invention enables nanoparticles to be assembled into free-standing films robust enough to be transferred to arbitary substrates. This is commercially important because this permits their deployment in engineered devices to be greatly accelerated.

Although much research has been done on the assembly of nanoparticles with a distribution of surface charge states, little has been done on the assembly of like-charged nanoparticles. In this case of like-charge nanoparticles, repulsive Coulomb interactions, as well as van der Waals, dipole-dipole, and steric interactions govern the types of assemblies that can form. The only nanoparticle deposition scheme that considers and accommodates the primary physical characteristics of the nanoparticles in the film formation and incorporates the most favorable attributes of NP deposition is electrophoretic deposition (EPD).

The invention can include film thickness of electrophoretic deposited (e.g, iron oxide) nanoparticles as a function of nanoparticle size. The invention can include the fabrication of free-standing nanoparticle thin films, comprised solely of electrophoretically deposited nanoparticles.

Therefore, the invention enables the intrinsic mechanical, structural, and optical, or magnetic properties of these free-standing nanocrystals films to be probed directly without the influence of substrate interactions. Engineering limitations, which arise from matching the deposition conditions for the film with the corresponding substrate, can thereby be circumvented by physically transferring the structure from its original deposition site to another location.

The invention can include a process for the fabrication of freestanding, all-nanocrystal thin film materials. A novelty of this process is that it facilitates the production of freestanding all-nanocrystal films using a sacrificial polymer layer. The invention does not require the use of specifically functionalized nanocrystals or chemical cross-linker molecules to produce the resulting thin film structure.

In general, useful application of functional nanocrystals requires the ability to manipulate and assemble them in a controlled fashion into a larger structure. The invention allows rapid, controlled assembly of nanocrystals into many-layered films, as well as further manipulation of the film as freestanding object capable of being isolated or placed in another location.

The invention can include a versatile approach to the creation of freestanding, macroscopic films comprised exclusively of nanocrystals. The films can be rendered independently of a supporting substrate and can be without an external supportive matrix, that is, these films can be entirely self-sustained metascale structures. To demonstrate the technique, thin films of oleic-acid-capped iron oxide nanocrystals ($Fe_3O_4$, diameter≈20 nm) were prepared by electrophoretic deposition (EPD) on polymer-coated substrates. The nanocrystals films were subsequently freed from their substrates by sacrificing the polymer layer (FIGS. 1A-1C). Additionally, by tuning the polymer sacrificial process, the invention enable increasing the lateral dimensions of the freestanding films by approximately an order of magnitude, with the largest film sections approaching a centimetre in length.

Producing a self-sustained nanocrystal film with macroscopic lateral dimensions is facilitated by the film being sufficiently thick with a healthy attractive interaction among neighboring nanocrystals. EPD is particularly appealing because it is a techniques that rapidly furnishes films multiple monolayers of tightly packed nanocrystals, with short-range Van der Waals interactions a stabilizing influence. The use of EPD is further motivated by observations that films produced by this technique can withstand degradation when exposed to various solvents. The invention can include a dc electric field applied between two planar electrodes that are inserted into a solution of charged, dipolar, or polarized nanoparticles in a dielectric solvent. These particles than are driven by the ambient electric field to aggregate on the surface of the electrodes.

Unlike nanocrystals films cast form solutions, films produced by EPD family adhere to their substrate. While this adhesion is beneficial for applications in which the films remain on the substrate, it precludes physical isolation or manipulation of the film. The invention can include depositing nanocrystal films on a temporary coating material that subsequently would be dissolved to free the films from their substrate. Although MEMS Fabrication processes often utilize $SiO_2$ as a sacrificial layer, with hydrofluoric acid (HF) as the preferred etchant,[12] the invention preferably includes employment of a polymer since there is a vast selection of polymers that can be solvated by solvents that are milder than HF.

Preferably, the choice of polymer needs to satisfy three major criteria: 1) the polymer allows the applied electric field to penetrate through it without suffering dielectric breakdown; 2) the polymer does not swell or dissolve in the nanocrystal solution during EPD; and 3) the polymer does dissolve in a solvent that does not damage the nanocrystal film. These requirements were satisfied by polystyrene, which has a dielectric constant of ~2.6 and experiences breakdown in fields stronger than 200,000 V/cm,[13] a threshold that is easily not exceeded by an EPD protocol. Hexane, the nanocrystal solvent during EPD, is a non-solvent polystyrene, while dichloromethane can be used to dissolve the polymer layer with minimal effect on the oleic acid-capped nanocrystals.

A film or iron oxide nanocrystals may be deposited over a thin layer (10-30 nm thick) of polystyrene by EPD. The nanocrystal film them may be freed from its solid substrate by exposing the sample to dichloromethane, which dissolves the polystyrene layer. In addition, the versatility of the invention has been demonstrated by using another polymer, 50:50 poly-lactic-co-glycolic acid) (PLGA), for the sacrificial layer as an approach to optimizing the lift-off process.

Figures 2A, 2B:
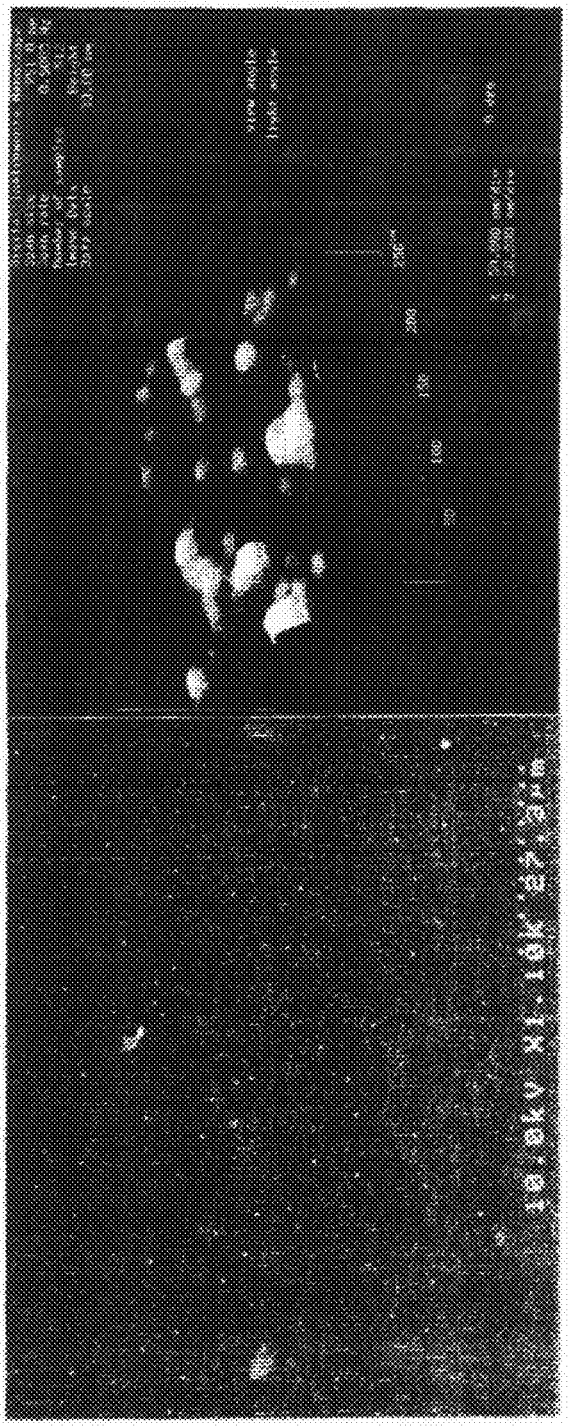
FIG. 2A depicts a scanning electron microscope image (SEM) of the surface topology of an electrophoretically deposited nanocrystal film.
FIG. 2B depicts an atomic force microscope image of the surface topology of an electrophoretically deposited nanocrystal film.

The electrodes for EPD were prepared by first spin coating polystyrene onto n-type silicon substrates, as detailed in the experimental section. Ellipsometry confirmed the polymer layer thickness to be in 10-30 nm range. The polystyrene-coated substrates were cut into approximately 1.3 cm×3 cm sections, and an acetone-soaked swab was used to expose a few millimetres of bare silicon near one end of each section to allow good electric connection with the EPD circuitry. The iron oxide nanocrystals (20 nm $Fe_3O_4$), synthesized by thermal decomposition of an iron-oleate complex,[14] were precipitated from the reaction mixture using a combination of ethanol and butanol, then recast in hexane. The nanocrystals were deposited from a concentrated hexane solution (~$4.8\times10^{13}$ per ml) using the EPD system, in which the polymer-coated electrode was paired with a blank p-type silicon electrode. The polymer-coated electrode was negatively biased in all the EPD runs. Depositions were performed with an applied field of 3000 V/cm over 20 minutes, followed by 5 minutes for drying while the field remained on. Even with a poor conductor like polystyrene (resistivity ~$10^{16}$-cm) covering the field-emanating surface, a glassy nanocrystal film was deposited over the polymer layer. The high electric field, not significantly attenuated by the polystyrene, still drove nanocrystal locomotion to each electrode. Scanning electron microscopy (SEM) confirmed the formation of smooth, uniform film on the polystyrene coating (FIG. 2*a*). Atomic force microscopy (AFM) revealed that the nanocrystals were tightly packed, not just laterally but along the z-axis as well (FIG. 2B). The measured RMS roughness of the surface, 3.4 nm, was less than the size of one nanocrystal.

The deposited nanocrystal film was liberated from its substrate by dissolving the underlying polystyrene layer. Dichloromethane was added drop wise to the electrode surface at the exposed polymer edge, allowing the solvent to creep along the length of the electrode toward the nanocrystal film as it solvated the polystyrene. As dichloromethane infiltrated the region under the nanocrystal film, the film detached, in several pieces, from the substrate and floated to the liquid surface. For the entire nanocrystal film, this lift-off process used less than 1 ml dichloromethane. Sub-millimetre sized fragments of film were recovered with a pipette and cast on a copper transmission electron microscopy grid for imaging.

Figure 3A:
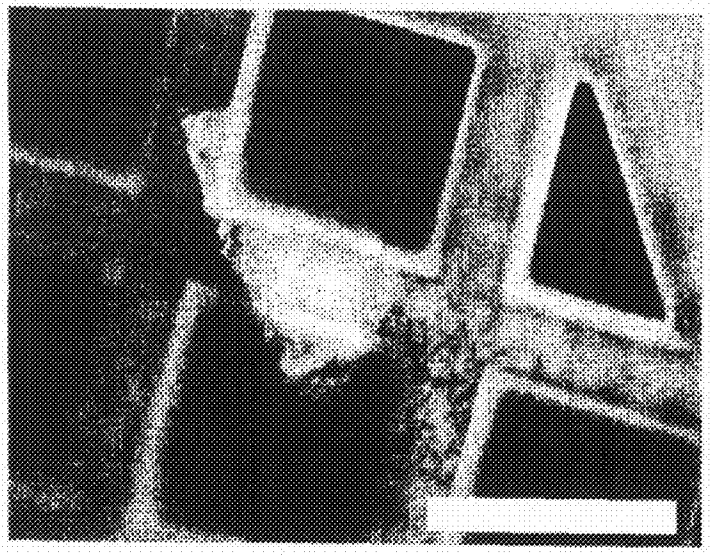
FIG. 3A depicts a low magnification SEM image of a freestanding nanocrystal film atop a graphite transmission electron microscope (TEM) grid.
Figure 3B:
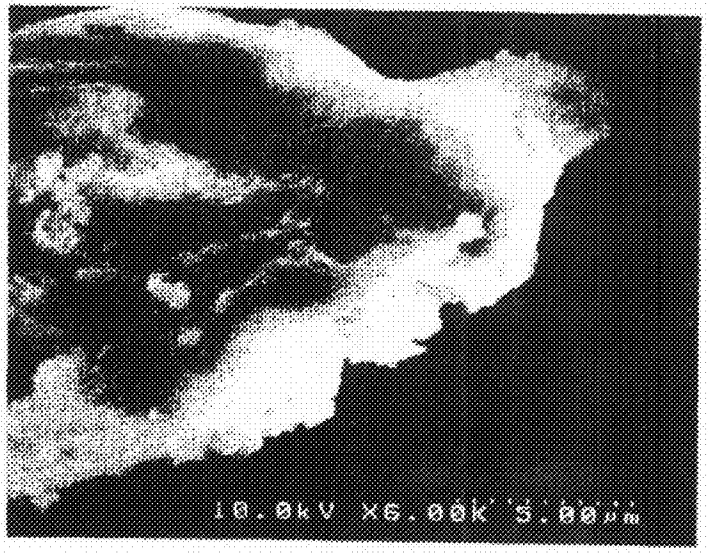
FIG. 3B depicts an SEM image of the freestanding nanocrystal thin film shown in FIG. 3A.

The freestanding film fragments are thin enough to be translucent, as seen in FIG. 3A. From the SEM image in FIG. 3B, it is apparent that one surface of the film is quite rough. While not being bound by theory, physical degradation of the sacrificial layer may be the cause of this roughness. In more detail, as dichloromethane solvates the polystyrene, individual polymer chains undergo changes in conformation that in turn upset the continuity of the nanocrystals at the polymer-nanocrystal interface. Disruptiveness of the dissolution process is to be avoided because it may be liable for fragmentation of the lifted-off film.

While the approach of dissolving the sacrificial layer suffices for proof of principle that freestanding all-nanocrystal films can be generated, integration of these films into practical devices necessitates the production of significantly larger sections of film. A more gentle technique for weakening a polymer sacrificial layer is preferably employed. The invention can include the use of PLGA, an aliphatic polyester, as an alternate lift-off process. When exposed to water, the PLGA copolymer is not initially solvated, but instead is cleaved by hydrolysis of its ester linkages. Eventually, the polymer is reduced to its water-soluble monomers, lactic acid and glycolic acid.[15] This process can be less physically disruptive, resulting in the liberation of larger nanocrystal film sections than those freed by the dissolution of polystyrene.

Electrodes coated with PLGA also were prepared via spin coating the polymer onto n-type silicon substrates. The electrodes were cut and mounted in the EPD system, and depositions of iron oxide nanocrystals were performed using the same parameters as were employed earlier. The films deposited on PLGA were comparable in appearance and surface morphology to those deposited on polystyrene. To liberate the nanocrystal film, each PLGA-coated electrode was positioned horizontally, film facing up, and dipped in dish of deionized water with the top face of electrode just below the air-water interface. After several minutes, sections of translucent nanocrystal film were observed floating on the water surface. The films were left in the water overnight to allow for the complete cleavage of the PLGA and removal of its monomers. Unlike the nanocrystal film fragments produced with polystyrene, these sections had lateral dimensions of at least 3 mm. This is an important commercial break though. The freestanding films were transferred to aluminium foil to dry. The pliability of the foil led to a serendipitous observation: the freestanding nanocrystal films were flexible, capable of adapting the contour of the surface on which they were placed. This is another important commercial break through.

The flexibility of the nanocrystal films can be attributed to specific aspects of their fabrication. Because we do not perform a post-deposition treatment with chemical cross linkers neighboring nanocrystals are not rigidly attached to one another. The films' of the invention's constituents are not necessarily bound by strong electrostatic interactions. Using data from the literature,[17,18] we calculated the energy of the Van der Waals interaction between the adjacent nanocrystals to be on the order of 100 meV. At room temperature, these forces compete against thermal fluctuations to keep the films stable. Disintegration of sufficiently thick films (>20 monolayer) is prevented in part through the confinement of interior nanocrystals' motion by overlying nanocrystals layers. Based on AFM imagery, a freestanding film representing an embodiment of the invention can be modelled as a collection of solid spheres, each surrounded by a supple hydrocarbon mesh. From its structural description, the hydrocarbon ligands' polymer-like lack of rigidity permits individual nanocrystals a limited range of motion that, collectively, engenders the flexibility observed in the real films.

Embodiment of the invention have demonstrated a technique that produces freestanding all-nanocrystal films with macroscopic lateral dimensions, using electrophoresis to assemble the films over a polymer sacrificial layer. The EPD method contributes significantly to versatility of the invention, allowing nanocrystal deposition on different polymer surfaces, and may be utilized for the deposition of multiple nanocrystal types in various combinations as well. Preferred embodiment of the invention can be identified without undue experimentation by embodiments that generate even larger sections of film. Inherent mechanical stresses, that often cause cracking in nanocrystal films may negatively impact the ability to produce very large sections of freestanding film. Counteracting their effects may require the spatially modulated selectively use of cross linkers, which in turn would have to be applied judiciously to prevent a loss of flexibility in the films. As the physical properties of this new class of "colloid solids" become better understood, we envision their integration in exciting applications such as flexible luminescent displays, magnetic sensors, and multifunctional coatings.

EXAMPLES

Specific embodiments of the invention will now be further described by the following, no limiting examples which will serve to illustrate in some detail various features. The following examples are included to facilitate an understanding of ways in which an embodiment of the invention may be practiced. It should be appreciated that the examples which follow represent embodiments discovered to function well in the practice of the invention, and thus can be considered to constitute preferred mode(s) for the practice of the embodiments of the invention. However, it should be appreciated that many changes can be made in the exemplary embodiments which are disclosed while still obtaining like or similar result without departing from the spirit and scope of the invention. Accordingly, the examples should not be construed as limiting the scope of the invention.

Iron oxide nanocrystals were synthesized using the method of Park et al,[14] Iron oleate precursor was formed by reacting 2.163 g $FeCl_3.6H_2O$ (Sigma Aldrich, 98% Reagent Grade) with 7.301 g sodium oleate (TCL) in a solvent comprising 12 ml deionized water, 16 ml ethanol, and 287 ml hexane at 70° C. for hours. The upper layer containing iron oleate was rinsed with deinonized water several times and removed using a separatory funnel. Nanocrystals were then grown by decomposition of iron oleate (8 mmol) in a mixture of 10.14 ml tri-n-octylamine and 254 l oleic acid. The mixture was heated to 330° C. at a rate of 5° C. per minute and allowed to reflux for 30 minutes, then cooled to room temperature. 1 ml of the resulting nanocrystal solution was combined with 15 ml ethanol and 20 ml butanol and centrifuged at 3500 rpm for 1 hour to precipitate the nanocrystals for suspensions in hexane. The EPD solution was prepared by dissolving the precipitated nanocrystals in 12 ml hexane, giving a final concentration of ~$4.8\times10^{13}$ nanocrystals per ml.

The polymer-coated electrodes were prepared by spin coating 0.15% w/V solutions of either polystyrene (Polymer Source, $M_w$ 212,000) in toluene or PLGA (Sigma-Aldrich, $M_w$ 15,000) in chloroform onto n-type silicon substrates. Each silicon surface was first flooded with solution then spun for 60 seconds at a rate between 2000 rpm and 2500 rpm, producing a polymer layer with thickness in the 10-30 nm range. The samples were dried overnight. Electrodes for EPD were prepared by cutting the polymer-coated silicon and blank p-type silicon into 1.3 cm×3 cm pieces. A small region of the polymer was wiped off using acetone to allow a good electrical connection with the EPD circuitry. Electrodes were mounted vertically in the EPD system with 2 mm separation in a parallel plate capacitor configuration. The p-type electrode was biased positively while the polymer-coated electrode was biased negatively.

To separate the nanocrystal film on the polystyrene layer, dicholoromethane was added drop wise to the electrode surface at the exposed polystyrene edge. As dicholoromethane infiltrated the region under the nanocrystal film, the film detached, in several pieces, from the substrate and floated to the liquid surface. Sub-millimetre sized fragments of film were recovered with a pipette on a copper transmission electron microscopy grid for imaging. To separate the nanocrystal film on the PLGA, the electrodes were dipped horizontally, film facing up, in a dish of deionized water. The freestanding films floating on the surface were transferred to aluminium foil to dry before further imaging.

The size of the synthesized nanocrystals were verified with a Philips CM20 transmission electron microscope using an accelerating voltage of 200 kV. The thickness of the polymer layers was measured using a J.A. Woolam M-2000 Spectroscopic Ellipsometer. Nanocrystal films were examined with Leitz Ergolux DIC photomicroscope fitted with an Angstrom Sun CFM-USB-2 digital camera, A Hitachi S4200 field emission scanning electron microscope operating at 10 kV, A Digital Instrument NanoScope III atomic force microscope operating in tapping mode.

Electrophoretic deposition (EPD) rapidly yields densely packed films for a broad selection of nanoscale materials suspended in various solvents. A balance of forces: attractive (van der Waals) and repulsive (electrostatic, steric) enables the electrophoretically deposited NP film to remain intact after it is liberated from the substrate. The close spacing of NPs achieved through EPD permits the NPs to approach the minimum in potential energy, approximately −2 kT, calculated for a pair of 14 nm iron oxide NPs capped with oleic acid ligands. The ligand molecules also serve to prevent the NPs from strongly binding to the underlying polymer sacrifical layer.

The invention can include stable nanoparticle suspensions in non-polar solvents, with a low electrolyte concentration. The NPs are preferably from ~1 nm to ~20 nm in diameter. The invention can include depositing onto conducting, insulating, and semiconducting substrates. Preferably, the EPD currents tend to be small ($I_{EPD}$<1 μA) with high voltages ($V_{applied}$>100V). This can be deemed the High Field-Low Current Regime.

Figure 4:
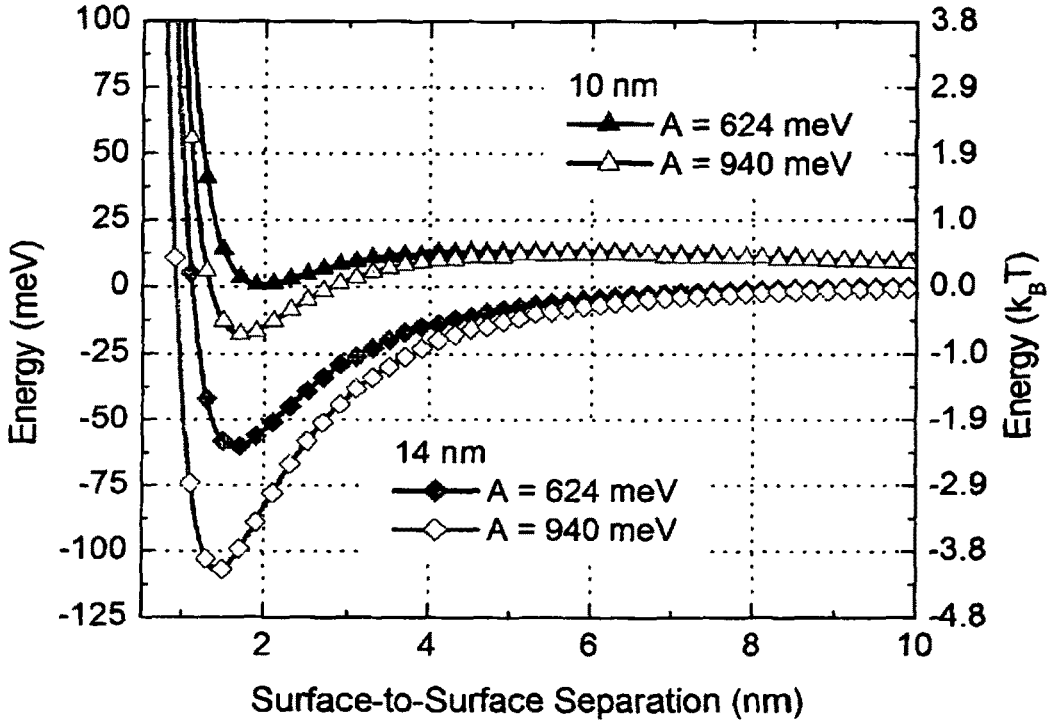
FIG. 4 depicts free energy of nanoparticle-only thin films as a function of surface-to-surface separation and $k_BT$ energy.

The van der Waals interaction between nanoparticles scales with the nanoparticle diameter. Referring to FIG. 4, it can be appreciated that the free energy of the thin film is a function of the surface-to-surface separate as well as $k_BT$. This relationship can be expressed as:

$$U(r)=\frac{1}{2}\sum_j\sum_k\frac{-A_{Hamaker}}{6}\left[\frac{d^2}{r_{jk}^2-d^2}+\frac{d^2}{r_{jk}^2}+2\ln\left(\frac{r_{jk}^2-d^2}{r_{jk}^2}\right)\right]+$$

$$\frac{1}{4\pi\mu}\sum_j\sum_k\left[\frac{\vec{m}_j\cdot\vec{m}_k}{r_{jk}^3}-3\frac{(\vec{m}_j\cdot\vec{r}_{jk})(\vec{m}_k\cdot\vec{r}_{jk})}{r_{jk}^5}\right]+\frac{MZ_1Z_2e^2}{4\pi\varepsilon\varepsilon_0\cdot r_{jk}}e^{-\kappa h}$$

Still referring to FIG. 4, overall nanoparticle-nanoparticle interaction suggests that binding energy is weaker than $k_BT$ at room temperature for at a critical nanoparticle diameter.

Figures 5A, 5B, 5C:
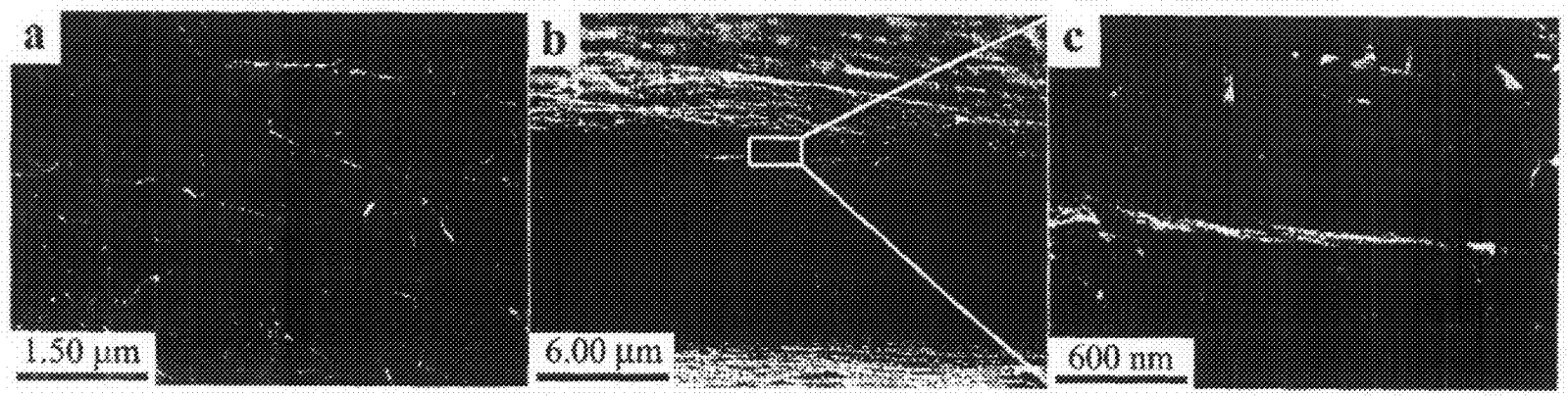
FIGS. 5A-5C depict a nanoparticle-only thin film of iron deposited on a carbon nanotube mat.
Figure 6A:
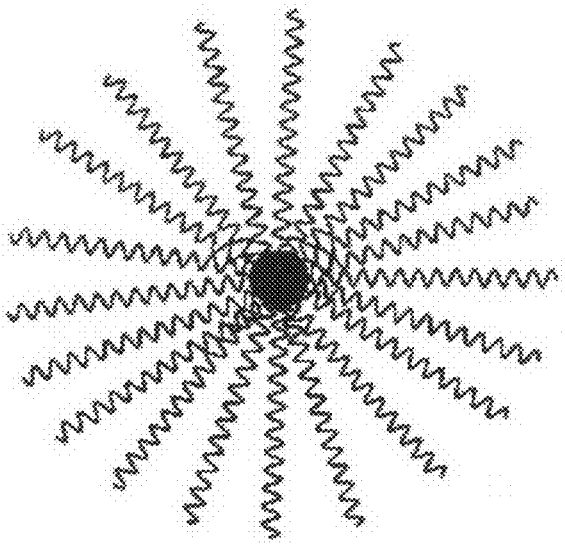
FIG. 6A depicts a star polymer macromolecule.
Figure 7C:
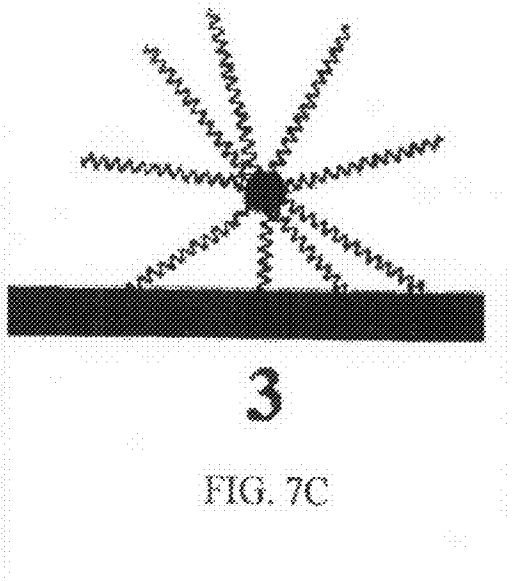
FIGS. 7A-7C depict a star polymer macromolecute interacting with a surface with a) strong adsorption: arms fully adsorbed to surface; b) intermediate adsorption: some arms adsorbed to surface; and c) weak adsorption: some arms partially adsorbed to surface.
Figure 7B:
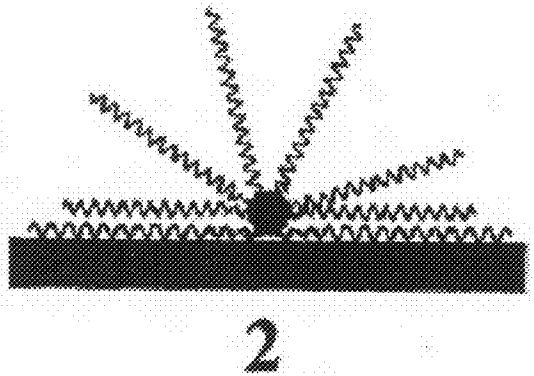
Figure 7A:
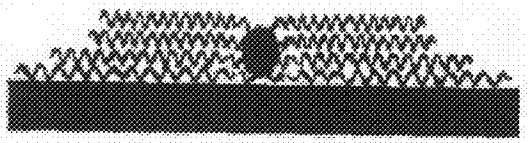
Figures 8A, 8B, 8C:
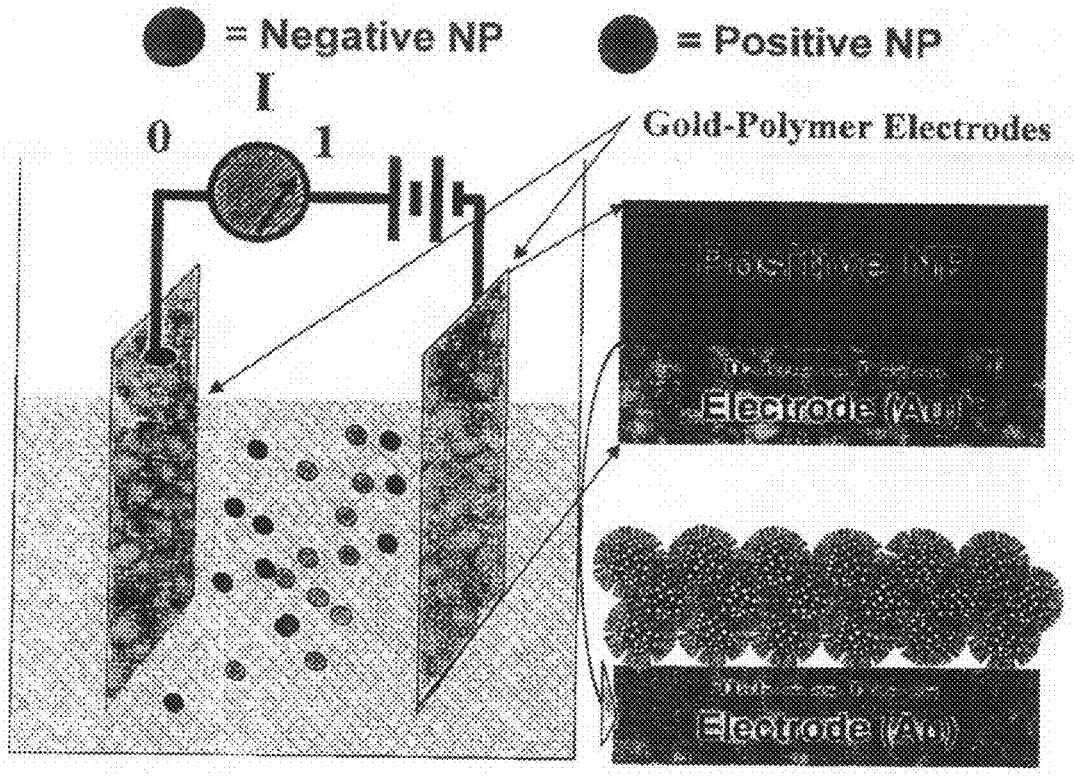
FIGS. 8A-8C depict a) a machine for EPD fabricating an all-nanoparticle thin film, b) positive nanoparticles on a polymer coated electrode and c) star polymer macromolecules on the polymer coated electrode.
Figure 9A:
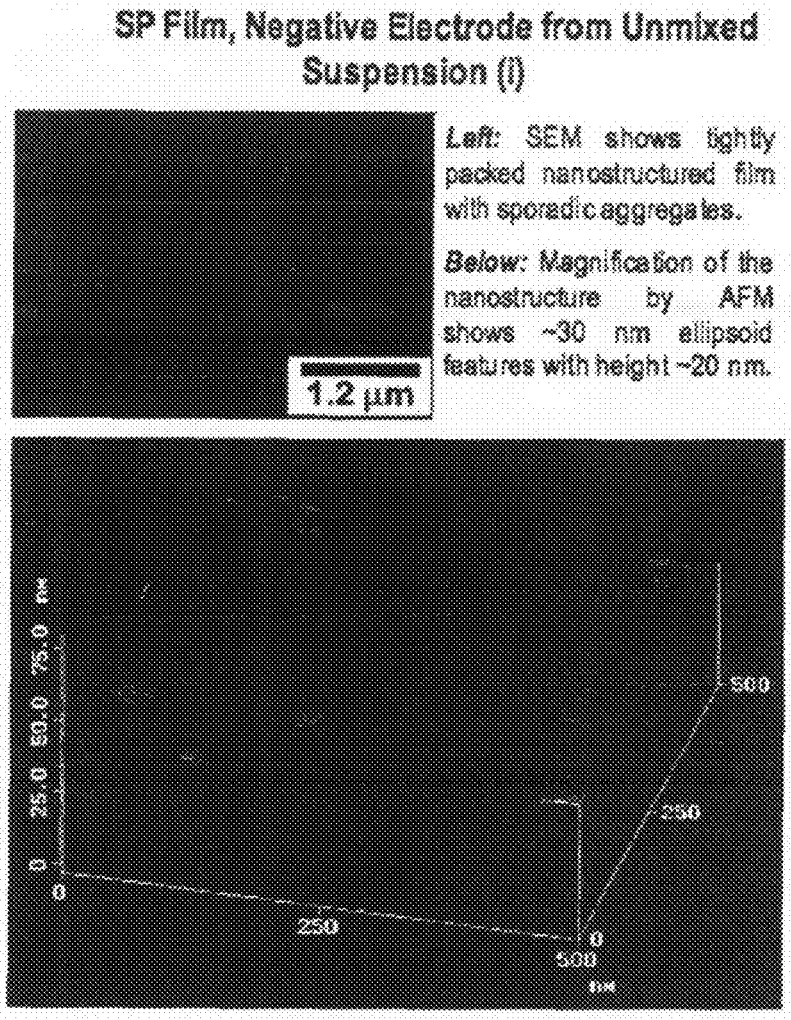
FIG. 9A depicts two views of a star polymer macromolecule nanostructured film on a negative electrode.
Figure 9B:
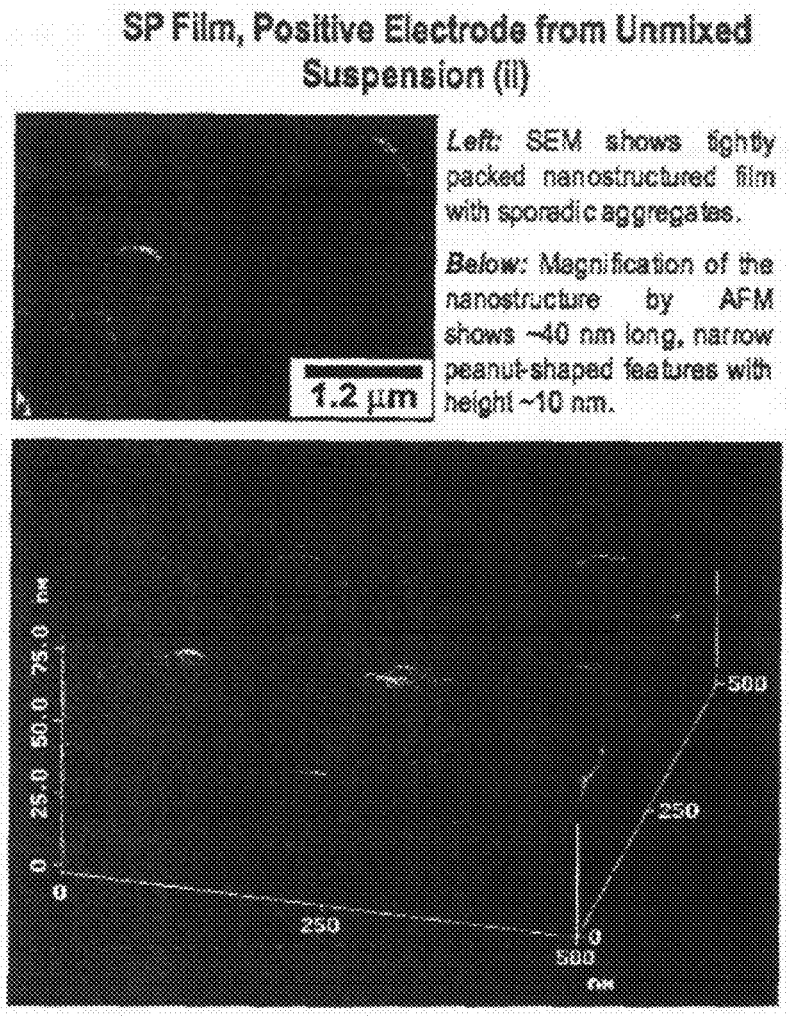
FIG. 9B depicts two views of another star polymer macromolecule nanostructured film on a positive electrode.

Referring to FIGS. 5A-5C, it can be appreciated that a discrete thin film of iron oxide nanoparticles can be fabricated on a carbon nanotube mat as part of a nanoparticle hereterostructure via electrophoretic deposition. The invention can include the fabrication of $Fe_2O_3$, $Fe_3O_4$, CdSe, CNT, star polymer, and other nanoparticle films with monolayer deposition control.

Electrophoretic deposition of nanomaterials in non-polar solvents via high field-low current can produce myriad compact, robust thin films for wide ranging applications. Nanocrystals, nanoparticles, and nanotubes can be deposited on both cathode and anode, depending on the charge state on the nanomaterials. Automated EPD schemes can rival other nanomaterials distribution techniques due to site selectivity, rapid deposition, size scalability, and inexpensive processing requirements. Various heterostructures, such as CNT-NC multilayers, enable prototypical devices such as supercapacitors and flexible video displays.

Unique Characteristics

The free-standing nanocrystalline thin films fabricated through electrophoretic deposition can possess unique material characteristics. The nanocrystalline films can be comprised of any metallic, semi conducting, or insulating nanocrystals or nanoparticle. The nanocrystalline films can contain no chemical cross-linkers or cross-linking agents. No user-added nanocrystal binding mediators are necessarily added to the nanocrystals prior to, during, or after the deposition. Preferably, the nanocrystalline films contain only the core nanocrystals, their growth-terminating, aggregation suppressing surface ligands, and air. Thus, preferably, the nanocrystalline films include only the individual constituent nanocrystal building blocks. The deposition technique allows for the production of films with macroscopic lateral dimensions (visible to the naked eye) and up to mesoscopic thickness (upwards of 1.0 microns). The nanocrystalline films may be freestanding, without a supportive matrix, provided by another material. The thickness of the nanocrystalline films are governed by particle-particle interactions, such as Van der Waals, steric, Cuolombic, dipole-dipole, and other interactions.

The nanocrystalline films can be detached from the original deposition site and can be deployed elsewhere. The nanocrystalline films are flexible and can conform to coat surfaces with virtually any contour.

Practical Applications

A practical application of embodiments of the invention that have value within the technological arts is in fabrication novel functional materials, including films and coatings.

Depending on whether the invention is applied to nanoparticles with interesting and useful magnetic, optical, luminescent, or absorptive properties, the commercial applications are nearly limitless. The invention is versatile and may be used for a wide variety of nanoparticles, such as nanocrystals. Further, embodiments of the invention are useful in conjunction with consumer electronic devices, such as incorporation of nanocrystalline phosphors into plasma display (as color phosphors) and liquid crystal display (as backlighting phosphors) devices, or such as incorporation of nanocrystalline magnetic materials into magnetic recording media and magnetic storage media, or the like. There are virtually innumerable uses for embodiments of the invention, all of which need not be detailed here.

REFERENCES

1. Achermann, M., et al., *Nanocrystal-based light emitting diodes utilizing high efficiency nanradiative energy transfer for color conversion*. Nano Letters, 2006, 6 (7): pages 1396-1400
2. Coe, S., et al., *Electroluminescence from single monolayer of nanocrystals in molecular organic devices*. Nature, 2002, 420 (6917): pages 800-803.
3. Sun, S. H., et al., *Monodisperse FePt nanoparticles and ferro magnetic FePt nanocrystal superlattices*. Science, 2000, 287 (5460): pages 1989-1992
4. Kong, J., et al., *Synthesis of individual single-walled carbon nanotubes on patterned silicon waters*. Nature, 1998, 395 (6705): pages 878-881
5. Morral, A. F. I., et al., *Synthesis of silicon nanowires with wurtzite crystalline structure by using standard chemical vapour deposition*. Advanced Materials, 2007, 19 (10): pages 1347-+.
6. Mamedov, A. A., and N. A. Kotov, *Free-standing layer-by-layer assembled films of magnetite nanoparticles*. Langmuir, 2000, 16 (13): pages 5530-5533.
7. Ariga, K., J. P. Hill, and Q. M. Ji, *Layer-by-layer assembly as a versatile bottom-up nanofabrication technique for exploratory research and realistic application*. Physical Chemistry Chemical Physics, 2007, 9 (19): pages 2319-2340.
8. Kuipers. E. W., C. Laszlo, and W. Wiedldraaijer, *Deposition of Nanocrystals on Flat Supports by Spin-Coating*. Catalysis Letters, 1993, 17 (1-2): pages 71-79
9. Islam, M. A. and I. P. Herman, *Electrodeposition of patterned CdSe nanocrystal films using thermally charged nanocrystals*. Applied Physics Letters, 2002, 80 (20): pages 3823-3825.
10. Tian, Y. C. and J. H. Fendler, *Langmuir-Blodgett film formation from fluorescence-activated, surfactant-capped, size-elected CdSe nanoparticles spread on water surfaces*. Chemistry of Materials, 1996, 8 (4): pages 969-974.
11. Islam, M. A., et al., *Controlled electrophoretic deposition of smooth and robust films of CdSe nanocrystals*. Chemistry of Materials, 2004, 16 (1): pages 49-54.
12. Hsu, T., *MEMS & Microsystems Design and Manufacturing*. 2002, McGraw-Hill.
13. Podgrabinski, T., et al., *Characterization of polystyrene and doped polymethylmethacrylate thin layers*. Journal of Materials Science-Materials in Electronics, 2005, 16 (11-12): pages 761-765.
14. Park, J., et al., *Ultra-large-scale syntheses of monodisperse nanocrystals*. Nature Materials, 2004, 3 (12): pages 891-895.
15. Kitchell, J. P., and D. L. Wise., *Poly(Lactic Glycolic Acid) Biodegradable Drug Polymer Matrix Systems*. Methods in Enzymology, 1985, 112: pages 436-448.
16. Lin, Y., et al., *Ultra thin cross-linked nanoparticle membranes*. Journal of the American Chemical Society, 2003, 125 (42): pages 12690-12691.
17. Kendall, K., *Adhesion-Molecules and Mechanics*. Science, 1994, 263 (5154): pages 1720-1725.
18. Lalatonne, Y., J., Richardi, and M. P. Pileni, *Van der Waals versus dipolar forces controlling mesoscopic organizations of magnetic nanocrystals*. Nature Materials, 2004, 3 (2): pages 121-125.
19. Lee. D., et al., *Viscoplastic and granular behavior in films of colloidal nanocrystals*. Physical Review Letters, 2007, 98 (2).
20. Islam, M. A., et al., *Addition, suppression, and inhibition in the electrophoretic deposition of nanocrystal mixture films for CdSe nanocrystals with gamma-$Fe_2O_3$ and Au nanocrystals*. Nano Letters, 2003, 3 (11): pages 1603-1606.
21. Mahajan, S. V., et al., *Structural properties of electrophoretically deposited europium oxide nanocrystalline thin films*. J. Master. Sci., 2006, 41 (24): pages 8160-8165.
22. Collier, C. P., et al., J. R. Annu. Rev. Phys. Chem., 1998, 49: pages 371-404.
23. Mahajan, S. V., et al., Nanotechnology, 2008, 19, 195301.
24. Somarajan, S., et al., J. Phys. Chem. B, 2008, 112, pages 23-28.

What is claimed is:

1. A method, comprising:

electrophoretically depositing a thin film of nanoparticles on a sacrificial layer; and freeing the thin film from the sacrificial layer, wherein the sacrificial layer includes poly(lactic-co-glycolic acid) and freeing the thin film includes water cleaving ester linkages to free the thin film from the sacrificial layer.

2. The method of claim 1, wherein the thin film includes no functionalized nanoparticles or chemical cross linkers.

* * * * *